United States Patent [19]

Park

[11] Patent Number: 4,501,357

[45] Date of Patent: Feb. 26, 1985

[54] DISK JACKET

[76] Inventor: Jong S. Park, Jung-Ku, Seoul, Rep. of Korea

[21] Appl. No.: 475,657

[22] Filed: Mar. 15, 1983

[30] Foreign Application Priority Data

Mar. 18, 1982 [KR] Rep. of Korea ..... 2068

[51] Int. Cl.[3] ..... B65D 85/30

[52] U.S. Cl. ..... 206/312; 383/95; 206/444

[58] Field of Search ..... 206/312, 444; 383/42, 383/81; 190/106, 121, 42; 150/16, 23, 15, 20

[56] References Cited

U.S. PATENT DOCUMENTS

| | | | |
|---|---|---|---|
| 2,327,532 | 8/1943 | Krupp | 150/42 |
| 3,254,688 | 6/1966 | Everburg | 150/42 |
| 3,642,102 | 2/1972 | Furniss et al. | 180/42 |

FOREIGN PATENT DOCUMENTS

| | | | |
|---|---|---|---|
| 746356 | 11/1966 | Canada | 200/312 |
| 111940 | 10/1968 | Denmark | 200/312 |
| 2274247 | 1/1976 | Fed. Rep. of Germany | 150/42 |
| 2414450 | 9/1979 | Fed. Rep. of Germany | 200/312 |
| 530043 | 12/1940 | United Kingdom | 150/42 |

*Primary Examiner*—Joseph Man Fu Moy

*Attorney, Agent, or Firm*—Jones, Tullar & Cooper

[57] ABSTRACT

A disk jacket is disclosed, the jacket having an outer envelope and an inner liner and being closed around three edges and opening outwardly along a top edge. A pair of outwardly curved elastic plates are secured between the outer envelope and the inner liner along opposite sides of the opening to cause the top edges of the opposed side walls of the jacket to be concave, whereby the mouth of the jacket is normally open. An interlocking latching mechanism is placed in the middle of the jacket opening to permit the jacket to be closed, and a covering, or lid, material is secured to the inner surface of the jacket liner along the upper edge thereof, the covering material being substantially the same thickness of a disk so as effectively to seal the opening of the jacket when it is secured in the closed position by the interlocking latch mechanism.

10 Claims, 3 Drawing Figures

DISK JACKET

BACKGROUND OF THE INVENTION

The present invention is directed, in general, to an improved disk jacket, and more particularly to an arrangement for firmly closing and securing the jacket opening.

Conventional disk jackets utilize a double structure including a thicker outer envelope adapted to receive a thinner liner, the disk being inserted into the liner, and the liner in turn being inserted into the outer envelope. Such an arrangement is inconvenient, since users must first take the inner liner out of the envelope and then remove the disk from the liner, thus leaving two separate parts of the jacket which must be located and reassembled when the disk is to be replaced. Further, since the opening of the outer envelope always remains open, the user has to pay close attention during the reassembly of the jacket to ensure that the liner is inserted upside down into the outer envelope in order to close off the liner opening and to protect the disk from dust and dampness.

SUMMARY OF THE INVENTION

It is an object of the present invention to overcome the inconvenience of the prior art disk jackets.

It is a further object of the present invention to provide an improved, unitary, disk jacket having a closure for protecting disks from dust and moisture.

Briefly, the present invention is directed to a disk jacket having an outer envelope and an inner liner, the jacket having an upper edge which provides an opening to the interior thereof. The outer envelope and inner liner are secured along opposite sides of the top edge to outwardly curved (i.e., concave) elastic plates of plastic, spring metal, or the like. The plates tend to curve the opposed walls of the jacket outwardly away from each other along the upper edge, the two opposed, outwardly concaved edges defining the top opening, or mouth, of the jacket. The jacket may be generally rectangular, with the remaining three edges of both the outer envelope and the inner liner being sealed to provide an enclosure for receiving a disk.

Secured to the opposed walls of the jacket, at about the middle of upper edge, are two cooperating elements of a suitable interlocking latching arrangement which are adapted to engage each other and cooperate to hold the opposed top edges of the jacket together to close the jacket opening. This interlocking mechanism may be a pivoting latch mechanism, a hook and eye arrangement, cooperating hook and loop portions of a material such as Velcro, or the like, the latching mechanism being sufficiently strong to secure the envelope in its closed position against the outward force exerted by the curved elastic plates.

The two parts of the latching arrangement are located on the inner surfaces of the opposed walls, and thus do not allow the upper edges of the opposite walls to abut each other when the jacket is closed. The space remaining between the opposed walls in the closed position is filled by a closure material, or lid, which may consist of a strip of soft, crushable material such as foam, non-woven cloth, or the like secured to the upper edges of the opposed walls and being of sufficient thickness to be slightly compressed between the opposed walls when the jacket is closed. This strip of material preferably is slightly thicker than the disk which is to be received in the jacket as well as being slightly thicker than the latching arrangement to insure that the gap between the opposed walls is completely sealed, leaving no cleavage through which air or moisture can pass. The lid material, or closure strips, may be secured to one interior wall of the jacket, to both walls, or a part of the strip may be secured to one wall and the remainder secured to the other wall, as desired.

When the interlocking latch arrangement is released, the outwardly curved elastic plates cause the opposed side walls of the jacket to curve away from each other, opening the jacket and permitting access to the interior for insertion or removal of the disk. The jacket can be reclosed simply by pressing the opposite walls toward each other so that the opposite walls engage the cover material. Upon fastening the interlocking latch arrangement, the jacket is secured in its closed position with the edges of the opening in engagement with the cover material to seal the interior of the jacket, thereby protecting the disk against dust and moisture.

BRIEF DESCRIPTION OF THE DRAWINGS

The foregoing and additional objects, features and advantages of the present invention will become apparent from a consideration of the following detailed description of a preferred embodiment thereof, taken in conjunction with the accompanying drawings, in which.

DESCRIPTION OF A PREFERRED EMBODIMENT

Figure 1:
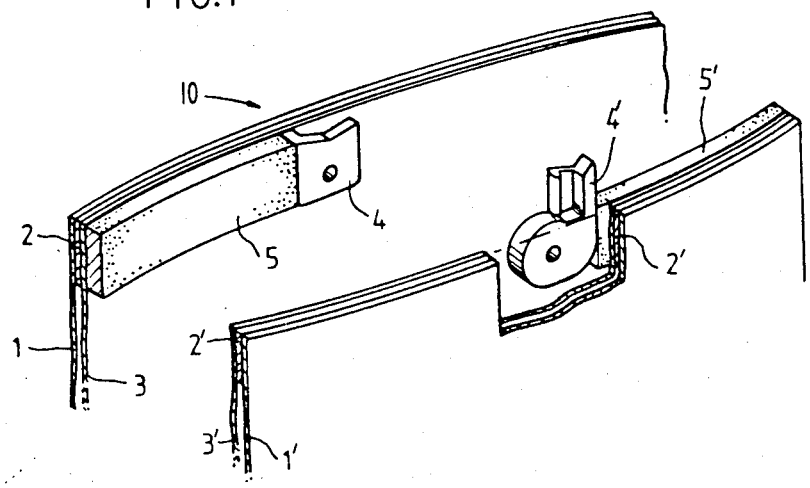
FIG. 1 is a perspective partial view of the disk jacket of the invention with a portion cut away to show one form of the interlocking closure mechanism of the present invention.
Figure 2:
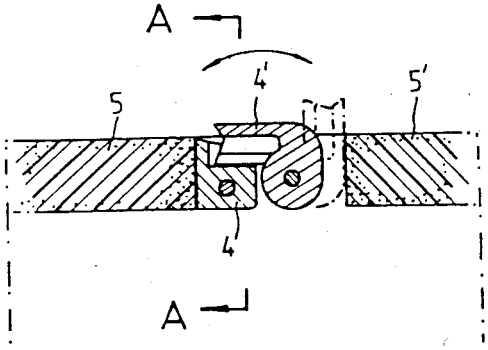
FIG. 2 is a partial sectional view taken through the closure assembly of FIG. 1 in its closed position.
Figure 3:
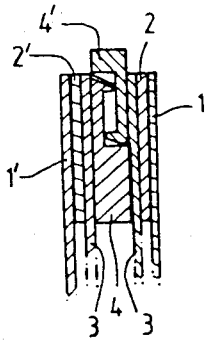
FIG. 3 is a cross-sectional view of the closure mechanism taken along line A—A of FIG. 2.

Turning now to a more detailed consideration of the present invention, there is illustrated in FIG. 1 a disk jacket 10 which includes an outer jacket or envelope portion 1, 1' which is conventionally shaped, and which, therefore, may be generally rectangular and sealed along its side and bottom edges to form an enclosed jacket to receive disks. The opposed side walls 1 and 1' of the jacket are spaced apart, and define along their respective top edges an opening into the interior of the jacket. Secured to and extending along the interior surface of the top edge of the opposed walls 1 and 1' of the jacket are a pair of curved plates 2 and 2', respectively, the plates being concave as viewed from the interior of the jacket opening so as to curve away from each other in the manner illustrated to hold the jacket open. The plates are of an elastic material such as plastic (e.g., P.V.C.) or spring metal, and are adhesively secured to the interior surface of the jacket walls.

Secured to the inner surfaces of the plates 2 and 2' is an inner liner 3, 3' which forms the inner wall of the disk jacket 10, and which is also sealed at its side and bottom edges to form the interior of the jacket. The outer surface of the upper edges of the liner walls 3 and 3' are adhesively secured to the inner surfaces of the elastic plates 2 and 2', respectively. The outer surface of the liner 3, 3' may be coated with an adhesive and secured thereby to the interior of envelope 1, 1'.

Mounted to the opposed walls of the jacket at approximately the center point thereof are two interlocking closure elements 4 and 4' which form a latch mechanism adapted to hold the jacket in a closed position. In a preferred form of the invention, the latch mechanism includes a pivotable latch arm 4' adapted to engage a receiver, or catch 4, but it will be understood that other interlocking latch mechanisms such as magnets, hooks and eyes, loop and hook material such as Velcro, or the like may be substituted.

In the illustrated embodiment, the two portions of the interlocking latch 4 and 4' are secured to the elastic plates 2 and 2', respectively, by means of suitable studs or the like which may be integrally formed with the plastic plates or which may be in the form of rivets or the like extending through the plates and the respective latch elements.

Secured along the inner surface of the liner walls 3 and 3', along the upper edge thereof, are strips of covering material 5 and 5' which may be of a spongy, crushable material such as foam, non-woven cloth, or the like. This material is adhesively secured to the liner walls 3 and 3' on opposite sides of the interlocking latch mechanism and preferably are about the same thickness as the disk which is to be stored in the jacket.

The elastic plates 2 and 2' may be made of P.V.C., spring metal, or the like and are very thin so as to keep the jacket thickness to a minimum. The particular order of assembly of the plates to the jacket may be varied from that illustrated, if desired. Thus, instead of locating the elastic plates between the envelope 1 and the liner 3, these two elements of the jacket may be adhesively secured together along the upper edges of the jacket and the elastic plates may then be adhesively secured either to the inner surface of liner 3 or to the outer surface of envelope 1. However, the illustrated arrangement is preferred. It will be understood that the sequence followed in securing the envelope, liner, and plate to each other may be varied.

In operation, when the latching mechanism 4 is unsecured, the curvature of the elastic plates 2, 2' holds the upper edges of the jacket walls apart so that the jacket is open, the space between the walls facilitating insertion and removal of a disk. By placing the interlocking mechanism in the middle of the upper part of the jacket, these elements will be at the point of greatest spacing between the jacket walls, thus preventing possible damage to the disk when it is inserted or removed.

When the jacket is closed and the interlocking latch is secured, the top opening between the walls of the jacket are sealed by the covering strips 5 and 5' so that there is no gap along the top wall. This insures that the disk will be protected from dust and humidity.

Although the present invention has been described in terms of a preferred embodiment, it will be understood that numerous variations and modifications can be made without departing from the true spirit and scope thereof as set forth in the following claims:

We claim:

1. A disk jacket comprising an envelope for receiving an disk, said envelope having first and second opposed walls closed along three corresponding edges and having corresponding first and second upper edges defining an opening:

first and second normally outwardly curved elastic plates secured along the length of said first and second upper edges, respectively, of said first and second opposed walls to seaparate said walls and to hold the jacket normally open at said opening, first and second interlocking means secured to said first and second upper edges, respectively, for holding said curved elastic plates together and thereby holding said opening closed; and covering means secured along said first and second upper edges to seal said opening upon closure thereof.

2. The disk jacket of claim 1, further including an inner liner secured within said outer liner and having top edges secured to corresponding top edges of said envelope by way of said curved elastic plates.

3. The disk jacket of claim 2, wherein said interlocking means is secured to the inner surface of said inner liner.

4. The disk jacket of claim 3, wherein said curved plates are secured between corresponding upper edges of said outer envelope and said inner liner.

5. The disk jacket of claim 2, wherein said interlocking means is secured midway along the lengths of said first and second curved plates and at the middle of the opening of said jacket, said interlocking means securing said elastic plates against their normal outward curvature.

6. The disk jacket of claim 2, wherein the upper edges of said envelope and said inner liner are adhesively secured to the outer and inner surfaces, respectively, of said curved plates.

7. The disk jacket of claim 2, wherein the outer surface of said inner liner is coated with adhesive, and is secured thereby to the inner surface of said envelope to form said jacket.

8. The disk jacket of claim 2, wherein the outer surface of the top edges of said jacket are covered with a protective tape.

9. The disk jacket of claim 1, wherein said interlocking means comprises a pivotal latch arm secured to a first of said curved plates, and a receiver element secured to a second of said curved plates, said latch arm being adapted to engage said receiver element to secure said jacket opening in a closed position.

10. The disk jacket of claim 9, wherein said covering means comprises a strip of sponge-like material of sufficient thickness to close the gap between the two upper edges of said jacket when said opening is secured in a closed position.

* * * * *